United States Patent [19]

Gelbar

[11] Patent Number: 4,529,136

[45] Date of Patent: Jul. 16, 1985

[54] SYSTEM FOR REMOVING AND REPLACING THE JOURNAL ROLLS FROM A COAL-PULVERIZING BOWL MILL

[75] Inventor: Danny E. Gelbar, Enfield, Conn.

[73] Assignee: Combustion Engineering, Inc., Windsor, Conn.

[21] Appl. No.: 564,154

[22] Filed: Dec. 22, 1983

[51] Int. Cl.[3] ..... B02C 15/00

[52] U.S. Cl. ..... 241/79; 241/121; 241/285 A

[58] Field of Search ..... 241/107–133, 241/285 R, 285 A, 285 B, 79

[56] References Cited

U.S. PATENT DOCUMENTS

| | | | |
|---|---|---|---|
| 2,848,170 | 8/1958 | Crites | 241/121 X |
| 4,127,237 | 11/1978 | Mehta et al. | 241/121 X |
| 4,133,488 | 1/1979 | Heinemann et al. | 241/285 A X |
| 4,372,496 | 2/1983 | Maliszewski | 241/121 X |

*Primary Examiner*—Mark Rosenbaum

*Attorney, Agent, or Firm*—Arthur L. Wade

[57] ABSTRACT

Jacks are positioned about the base of a coal pulverizing bowl mill to elevate the separator housing which contains and supports the journal rolls. The separator housing is raised by the rollers attached to the jacks. Once raised, the housing is rotated to sequentially position the access door of each journal roll to the front of the mill. A mobile crane conveyance is stationed at the front of the mill to remove and replace each journal roll through its access door.

3 Claims, 3 Drawing Figures

SYSTEM FOR REMOVING AND REPLACING THE JOURNAL ROLLS FROM A COAL-PULVERIZING BOWL MILL

TECHNICAL FIELD

The present invention relates to the removal and replacement of journal rolls from a coal-pulverizing bowl mill. More particularly, the invention relates to making the journal rolls within the separator housing accessible to a mobile crane conveyance at a single location.

BACKGROUND ART

Familiar to those skilled in the utility furnace art, the coal pulverizing bowl mill remains a huge, noisy, exotic unit of machinery gulping down a continuous supply of coal and delivering it pulverized to the waiting burners of the furnace. These mills are characterized by a rotating table upon which the coal is directed into the journal rolls which bear down upon the table and reduce the coal to a specified mesh size. The coal, pulverized between the journal rolls and upper surface of the table, is discharged over the outer periphery of the table where warm air is supplied to dry the coal and entrain it for conveyance upward through the separator housing. Veins are mounted beyond the periphery of the table to guide the air-entrained coal, returning the larger sizes to the table and sweeping properly sized coal particles into discharge conduits, allowing the fuel to be delivered to the furnace burners. The journal rolls are supported within the volume of the dome formed by the separator housing above the table.

The mechanical wear on the table and rollers is one of the primary concerns of those skilled in this art. Despite admirable advances in materials and structural arrangements, the journal rolls supported by the separator housing framework must be periodically removed for service, repair, and even replacement, through access doors provided in the wall of the separator housing for each journal roll. In the past, a permanent craneway was provided with which to jockey each journal roll and its mounting fixtures out of the access door for removal to an area where service, repair, and replacemnt are performed.

The problem of removing and replacing journal rolls is raised to monumental proportions by the limited access to the mill. Each unit of equipment essential to the furnace operation is necessarily positioned close to the mill. The mill is nested in this technological tangle of equipment and connecting conduits, leaving only enough floor space to get a mobile crane conveyance to a single position in front of the mill. Thus, the permanent overhead craneway, in the order of 40 tons of structural steel, has been required to reach the journal rolls through their access doors spaced around the wall of the separator housing. If a mobile crane can have the journal rolls brought to it at a single available station, the craneway could be eliminated with a savings of significant magnitude.

Rather than attacking the problem of access by rearranging the units surrounding the mill to provide multiple pathways to the mobile crane, a solution is seen in redesigning the mill, itself, to bring the journal rolls to the single station already available.

DISCLOSURE OF THE INVENTION

The present invention contemplates providing a flange with a horizontal surface on the lower periphery of the separator housing of a pulverizing mill which will be engaged by jacks spaced about the housing. The jacks are mounted in fixed relationship to the mill base. The upper end of each jack carries a roller with which to engage the downwardly facing flange surface of the separator housing, and when the housing is elevated to clear it from its base on the mill, power means will be applied to rotate the housing and thereby bring each access door for its journal roll to the common position at the front of the mill.

The invention further contemplates that a guide structure will be mounted between the elevated separator housing and the base of the mill so that when the housing is rotated from its original mating position with the base, it may be returned to the original position to register with the base and lowered for securing the two together.

The invention further contemplates that the jacks will be uniformly placed circumferentially about the housing to engage the housing flange, the jacks being mounted on a structure connected to the base of the mill.

The invention further contemplates that at least one of the rollers of the jacks engaging the separator housing flange will be actuated to apply rotational force to the housing.

Other objects, advantages and features of this invention will become apparent to one skilled in the art upon consideration of the written specification, appended claims, and attached drawings.

BRIEF DESIGNATION OF THE DRAWINGS

BEST MODE FOR CARRYING OUT THE INVENTION

Prolog To Detailed Descriptions

Figure 1:
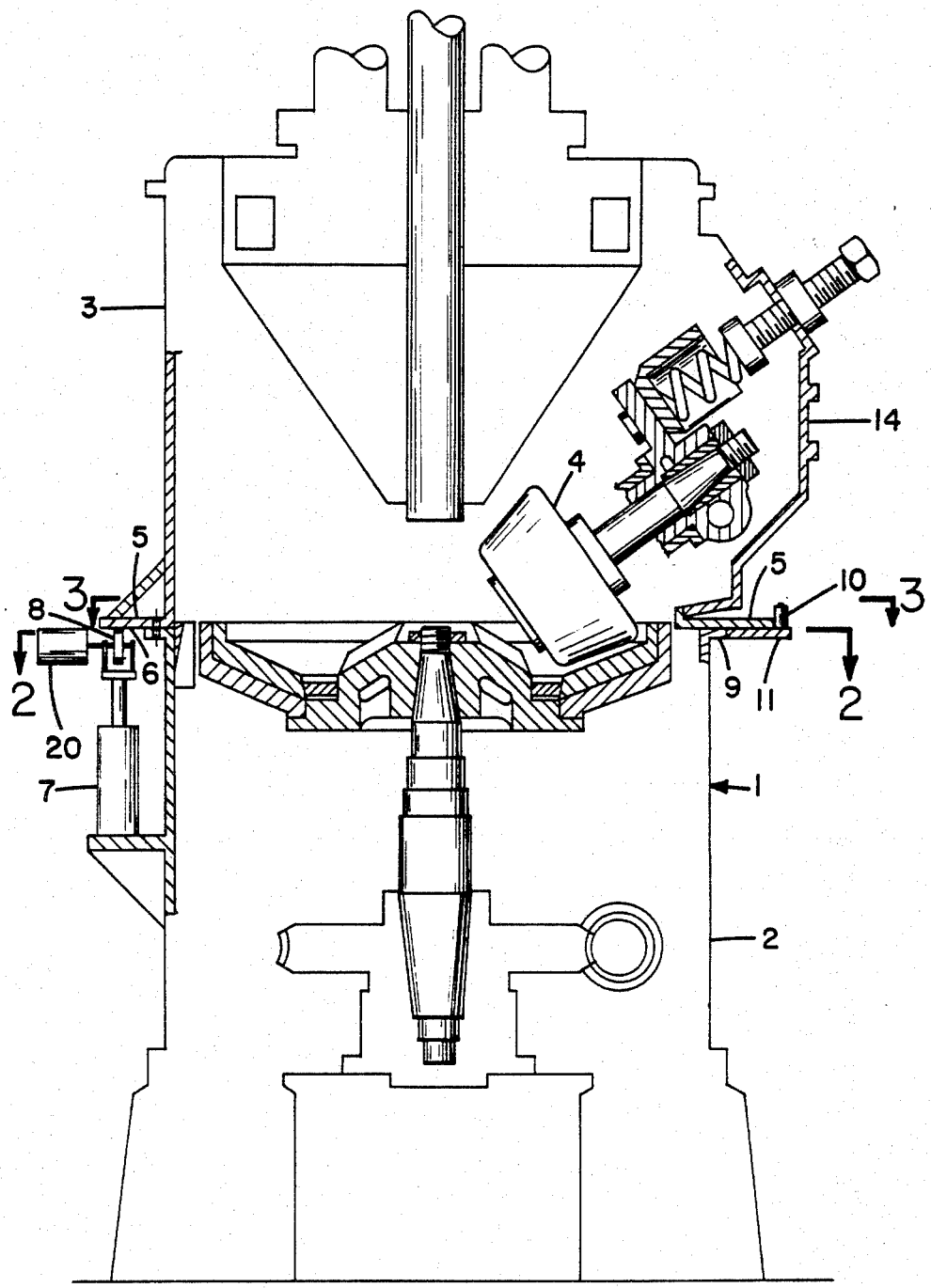
FIG. 1 is a sectioned elevation of a bowl mill in which the present invention is embodied, showing a journal roll positioned at the front of the mill for removal.

A mill 1 will be described, basically, as having a lower base portion 2 and an upper separator housing 3. In functioning together with detachable connecting structure, these two portions of the mill contain the table and journal rolls which pulverize coal in a well-known manner. The present invention is embodied in structure added to those components required for normal operations.

It is emphasized with monotonous repetition that the separator housing not only functions to guide the coalentraining air, but also functions as a support for the heavy journal rolls which crush the coal pouring from the center of the table. After detaching the separator housing and journal rolls from the base, the structure embodying the invention rotates the access doors to a common station in sequence. It is expected that this common station will be at the front of the mill to provide for general access by personnel.

The removal of the journal rolls and their mounting fixtures is well known. The end result of the invention brings each journal roll and its access door to the front of the mill, where this well-known removal and replacement procedure can be carried out with a mobile crane-type conveyance.

It is not to be overlooked that the separator housing is not only disconnected from the base, characterized by the table, but it must be disconnected from conduits which allow the pulverized coal to be removed from the upper region of the separator housing to its point of use in the furnace. However, once the plebian task of disconnecting the separator housing from the external attachments is completed, the embodiment of the present invention elevates the separator housing, provides for its rotation, and ensures that it is guided in register with its external connections during the rotation and upon reconnection. In addition to the savings in capital formerly expended for a permanent craneway, the present invention ensures a significant savings in both labor and time to perform the task of removing and replacing rolls.

The Structure In Detail

Mill 1 is sufficiently identified in its base 2 and separator housing 3. Although these mills come in various sizes, it is conservative to assume journal rolls 3 to 5 feet in length and weighing in the order of one ton. A plurality of journal rolls 4 are provided. The specific number is not important; whatever number of journal rolls 4 is provided, they are sequentially brought to a station where the access door 14, associated therewith, can be removed and a mobile crane conveyance may be positioned to remove them from separator housing 3.

The separator housing and base will be separated after their detachable connections have been released to enable the separation to take place. A flange 5 has been formed on the lower portion of the separator housing to provide downwardly-facing surface 6, up against which the jacks will bear to move the separator housing upward. The maximum number of jacks does not limit the invention. At least three jacks 7 are contemplated. Jacks 7 are placed uniformly around the periphery of flange 5 and each jack brings a roller 8 to bear upon surface 6. Three jacks with rollers are disclosed in FIG. 2.

The structure of the jacks, hydraulic or mechanical, does not limit the invention. The jack is simply a device for applying uniform upward force on surface 6 to hoist the disconnected separator housing free and clear of its connections with the base. Once the separator housing is elevated free and clear, the rollers between the jacks and the housing enable the housing to be rotated to bring the access doors to the mobile crane conveyance in sequence. It is assumed that disconnection will also be carried out between any conduits or other structure connected to separator housing 3 which might encumber its rotation. The force with which the housing is rotated may be applied by a motive means 20 connected to at least the roller of one of the jacks. By whatever means, horizontal force is applied to the housing and the housing is rotated easily as it is supported upon the jack rollers.

Figure 3:
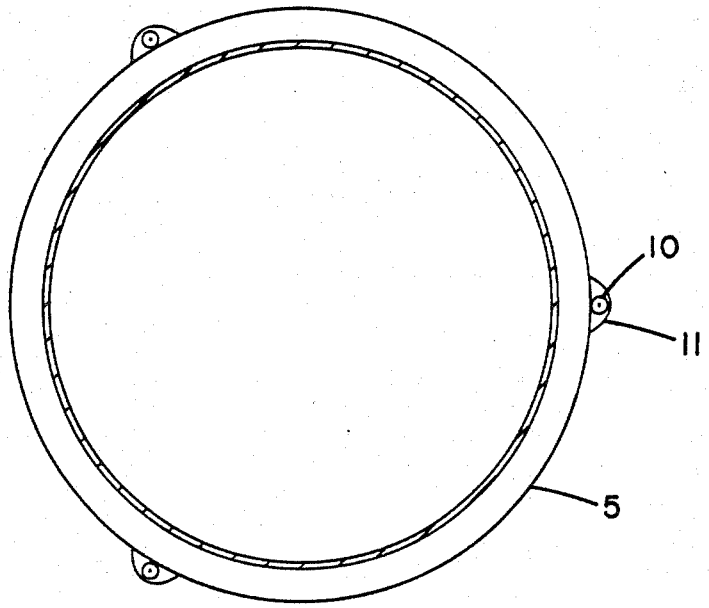
FIG. 3 is a section along lines 3—3 in FIG. 1 showing the guide pins maintaining alignment between the mill base and separator housing.
Figure 2:
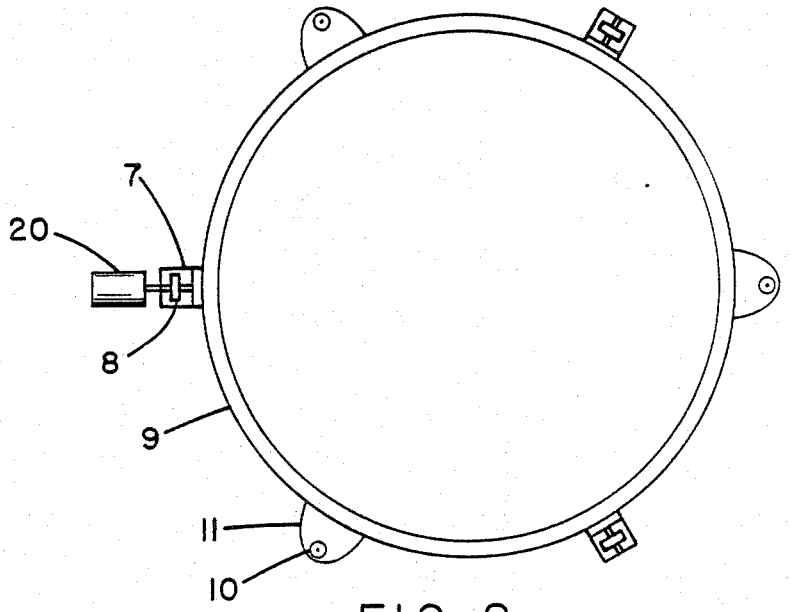
FIG. 2 is a section along lines 2—2 of FIG. 1 showing the rollers mounted on the jacks engaging the separator housing.

It is vital to the success of the invention that a guide be positively provided to return the separator housing into proper register with the base. After removal of the journal rolls has been made and they are returned to their proper location within the separator housing, the jacks are operated to lower the separator housing to its original position. Guide or register structure is embodied in pins 10 to ensure alignment of the connecting means between the base and separator housing so that when the jacks lower the housing, reconnection may be made accurately, smoothly, and efficiently. Three pins 10 are shown in FIGS. 2 and 3 supported on extensions 11 to the flange 9 of base 2.

From the foregoing, it will be seen that this invention is one well adapted to attain all the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A coal-pulverizing bowl mill having journal rolls and a base characterized by a circular rotating table having an upper surface enclosed by an upper separator housing, said upper separator housing arranged to support the journal rolls at the surface of the table for reducing the size of coal discharged onto the table, including, an access door for each journal roll in the side wall of the separator housing, a detachable connection between the base of the mill and the upper separator housing of the mill, a plurality of vertical jacks connected to the base of the mill and upwardly actuating a roller on each jack, a flange connected to the separator housing and extending a circular horizontal surface above the jack so as to be engaged by the rollers of the jacks as the rollers are moved upward until the housing is disengaged from the base of the mill, and a means for rotating the disengaged housing to bring each access door to a common station in sequence.

2. The mill of claim 1, including, guide structure between the disengaged separator housing and the base structure of the mill to maintain their alignment as the separator housing is rotated to the common station and returned to its original position.

3. The mill of claim 1, wherein, means for rotating the disengaged separator housing includes a motive means connected to at least one of the jack rollers.

* * * * *